United States Patent [19]

Roeder

[11] Patent Number: 4,744,730

[45] Date of Patent: May 17, 1988

[54] DOWNHOLE JET PUMP WITH MULTIPLE NOZZLES AXIALLY ALIGNED WITH VENTURI FOR PRODUCING FLUID FROM BOREHOLES

[76] Inventor: George K. Roeder, P.O. Box 4335, Odessa, Tex. 79760

[21] Appl. No.: 844,554

[22] Filed: Mar. 27, 1986

[51] Int. Cl.[4] ..... F04F 5/00

[52] U.S. Cl. ..... 417/172; 417/176

[58] Field of Search ..... 417/54, 151, 172, 176, 417/195, 198

[56] References Cited

U.S. PATENT DOCUMENTS

| | | | |
|---|---|---|---|
| 801,641 | 10/1905 | Boetcher | 417/174 |
| 1,642,121 | 9/1927 | McMahon | 417/76 |
| 1,845,675 | 2/1932 | Martin | 417/172 X |
| 2,004,337 | 6/1935 | Murphey | 417/176 |
| 2,041,803 | 5/1936 | Wolff | 417/172 |
| 2,290,141 | 7/1942 | Burt | 417/172 X |
| 2,291,911 | 8/1942 | McMahon | 417/172 |
| 2,682,225 | 6/1954 | Coberly | 417/176 X |
| 3,062,149 | 11/1962 | Jacuzzi | 417/172 X |
| 3,216,368 | 11/1965 | Waldron | 417/172 |
| 3,781,134 | 12/1973 | Brown et al. | 417/176 |
| 3,915,595 | 10/1975 | Roeder | 417/393 |
| 4,135,861 | 1/1979 | Brown et al. | 417/172 X |
| 4,183,722 | 1/1980 | Roeder | 417/172 |
| 4,285,638 | 8/1981 | Clark | 417/172 |
| 4,293,283 | 10/1981 | Roeder | 417/172 |
| 4,603,735 | 8/1986 | Black | 417/172 X |
| 4,605,069 | 8/1986 | McClaflin et al. | 417/172 X |
| 4,664,603 | 5/1987 | Priestly | 417/172 |

FOREIGN PATENT DOCUMENTS

| | | | |
|---|---|---|---|
| 2026093 | 1/1980 | United Kingdom | 417/172 |
| 922334 | 4/1982 | U.S.S.R. | 417/176 |
| 1126727 | 11/1984 | U.S.S.R. | 417/172 |
| 1206493 | 1/1986 | U.S.S.R. | 417/172 |

*Primary Examiner*—Carlton R. Croyle
*Assistant Examiner*—Paul F. Neils
*Attorney, Agent, or Firm*—Marcus L. Bates

[57] ABSTRACT

A downhole pump of the jet type is placed below the fluid level in a wellbore and is used to produce fluid from the wellbore by employment of a power fluid source located above the surface of the ground. The power fluid flows downhole to the pump and through the jet pump assembly to cause a pumping action. The jet pump includes a suction chamber formed about a nozzle assembly. The nozzle assembly is spaced from a venturi throat. The venturi throat diverges in a direction away from the nozzle. The nozzle is located close to the bottom of the pump adjacent the formation fluid inlet at a position which precludes contamination thereof with debris which may otherwise fall downhole into the nozzle. The power fluid exits from the nozzle and enters the inlet of the venturi, causing produced fluid to be pulled into the throat entrance and mixed with the power fluid. The mixed fluids continue to flow through the throat and out the venturi as the mixed fluids are forced to continue through the pump and then uphole to the surface of the earth. The pump includes a single nozzle as well as multiple nozzle and throat combinations.

3 Claims, 4 Drawing Sheets

DOWNHOLE JET PUMP WITH MULTIPLE NOZZLES AXIALLY ALIGNED WITH VENTURI FOR PRODUCING FLUID FROM BOREHOLES

PRIOR ART

| PRIOR ART | | | |
|---|---|---|---|
| Jamison | 121,376 | Coberly | 2,682,225 |
| Guethler | 636,333 | McArthur, et al | 2,653,786 |
| Labadie | 676,239 | Roeder | 3,453,963 |
| Great Britain | 735,866 | Roeder | 3,517,741 |
| Boetcher | 801,641 | Roeder | 3,540,814 |
| Morison | 1,055,210 | Roeder | 3,625,288 |
| Germany | 1,160,602 | Roeder | 3,627,048 |
| Kemble | 1,258,418 | Roeder | 3,650,640 |
| Lang | 1,372,149 | Roeder | 3,703,926 |
| Lang | 1,372,150 | Brown | 3,781,134 |
| Ehrhart | 1,548,029 | Roeder | 3,865,516 |
| McMahon | 1,642,121 | Roeder | 3,915,595 |
| Overstreet | 1,782,310 | Roeder | 3,957,400 |
| Martin | 1,845,675 | Roeder | 3,974,878 |
| McMahon | 1,992,436 | Roeder | 4,026,661 |
| Wolff | 2,041,803 | Roeder | 4,032,266 |
| McMahon | 2,080,623 | Roeder | 4,088,328 |
| McMahon | 2,114,905 | Roeder | 4,118,154 |
| Burt | 2,187,486 | Brown, et al | 4,135,861 |
| Jeffery | 2,191,717 | Roeder | 4,183,722 |
| | | Roeder | 4,293,283 |

The above prior art is cited to show the background of the present invention. My previous patents are cited to show the details of various different downhole hydraulically actuated pumps. My previous U.S. Pat. Nos. 4,183,722 and 4,293,283 and the art cited therein are considered the closest prior art known to me at this time. Some of my prior patents have been cited to show the details of the packer nose assembly and the standing valve assembly.

BACKGROUND OF THE INVENTION

This invention relates to improvements in downhole jet pumps of the type having provisions by which high velocity power fluid is forced through a nozzle into a throat area which creates a suction in its wake. This invention provides an advantage over my previous U.S. Pat. Nos. 4,183,722 and 4,293,283 and other known jet pumps by the employment of a nozzle and throat design located adjacent the bottom end of the pump.

In my previous patents, the nozzle and throat are located at the top of the pump where sand, gravel, and other debris fall onto the pump and become entrained with the flowing fluid which sometimes obstruct the nozzle.

The present invention also has provisions whereby one or a multiplicity of nozzle and throat combinations may be employed in a single pump body.

SUMMARY OF THE INVENTION

This invention teaches improvements in jet pumps, and in particular a jet pump having a concentrically arranged suction chamber, nozzle, and venturi. The suction chamber is formed about the nozzle and venturi inlet, and is connected to a formation fluid source so that when power fluid is forced to flow through the nozzle and into the venturi, the resulting stream of fluid entrains the formation fluid located within the suction chamber, so that mixed fluid flow occurs into the throat of the venturi.

The nozzle is located as close to the formation fluid inlet as possible. The power fluid is conducted down through the pump housing and connects to the nozzle at the lower end of the pump assembly. A single or multiple nozzle and throat combination is provided so that a proper flow rate of power fluid can be maintained through the nozzle and thereby achieve optimum efficiency of operation.

Produced fluid and spent power fluid therefore flow from the discharge opening into a produced fluid outlet of the pump, where the comingled spent power fluid and the produced fluid are then forced to flow to the surface of the earth. The pump of the present invention can be used in deep or shallow wellbores, and can be of the free or fixed type.

Accordingly, a primary object of the present invention is the provision of improvements in downhole jet-type pumps.

Another object of the present invention is the provision of a jet-type pump which can be provided with one or a plurality of nozzle and throat combinations.

A further object of this invention is to disclose and provide a jet-type downhole pump having apparatus associated therewith which provides for flow of power fluid through the nozzle and into the throat entrance with the nozzle being located as close as possible to the formation fluid inlet.

An additional object of this invention is the provision of improvements in downhole jet-type pumps for producing oil wells.

These and various other objects and advantages of the invention will become readily apparent to those skilled in the art upon reading the following detailed description and claims and by referring to the accompanying drawings.

The above objects are attained in accordance with the present invention by the provision of a combination of elements which are fabricated in a manner substantially as described in the above abstract and summary.

DETAILED DESCRIPTION OF THE PREFERRED EMBODIMENT

Figure 1:
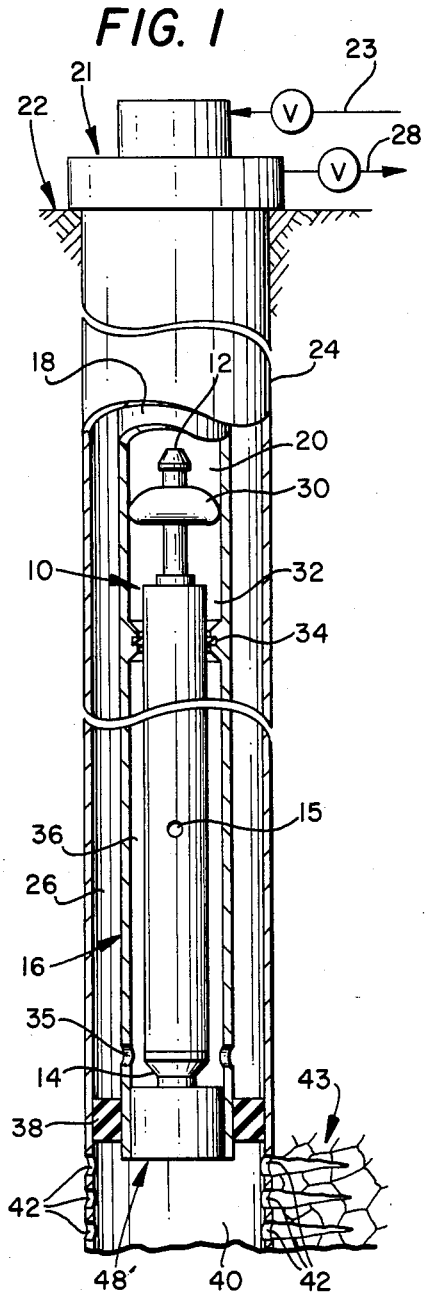
FIG. 1 is a broken, longitudinal, cross-sectional representation of the present invention operatively disclosed in conjunction with a hydrocarbon producing wellbore.

FIG. 1 is a diagrammatical illustration of a jet pump 10 made in accordance with the present invention. The pump includes a power fluid inlet 12 at the upper end thereof and a formation fluid inlet located at the opposed end 14 thereof. Produced and spent power fluids are discharged through outlet ports 15.

The pump 10 is illustrated in combination with a pump cavity 16. The details of the pump 10 are set forth in FIG. 3 while the details of the pump cavity 16 are set forth in FIG. 2. Alternate embodiments of the pump are set forth in FIGS. 4–8.

The pump cavity 16 supportingly receives the lower end 14 of the pump body in the same manner of a conventional downhole hydraulic pump, and provides a formation fluid inlet passageway thereinto.

In FIG. 1, a power oil tubing 18 conducts flow of power fluid through the interior 20 thereof, and downhole to the pump 10. The tubing 18 is supported from a wellhead 21 located above ground surface 22. A supply of power fluid flows from a surface pump (not shown), along fluid conductor 23, and downhole into the interior 20 of the power oil tubing 18. Well casing 24 is concentrically arranged respective to the tubing and forms annulus 26 therebetween through which produced fluid and spent power fluid can flow up the borehole and out of the usual Christmas tree or wellhead 21 located above the ground.

Figure 3:
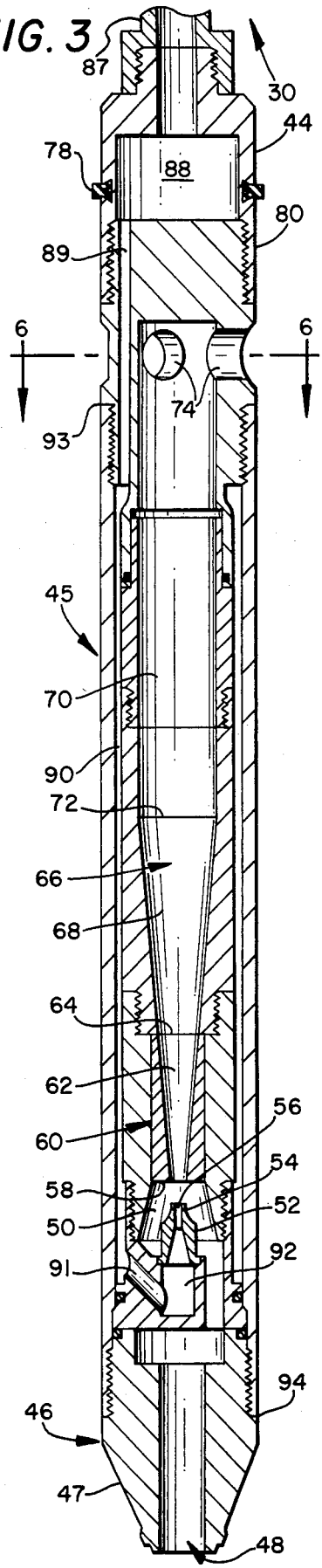

In the embodiment of the invention disclosed in FIGS. 1 and 3, a packer nose assembly 30 separates annulus 32 from the tubing interior 20, while a seal ring 34 sealingly cooperates with the main body of the pump to separate the annulus 36 from the annulus 32. Ports 35 are formed along a marginal length of the pump cavity 16 and communicate the cavity annulus 36 and casing annulus with one another. Packer device 38 anchors the pump cavity, or the lower end of the tubing string 18, to the lower end of the casing string 24 and prevents the occurrence of fluid flow between annulus 26 and the lower casing interior 40. Perforations 42 communicate a payzone or production formation 43 with the casing interior 40, thereby providing a source of formation fluid at production inlet 48'.

Figure 2:
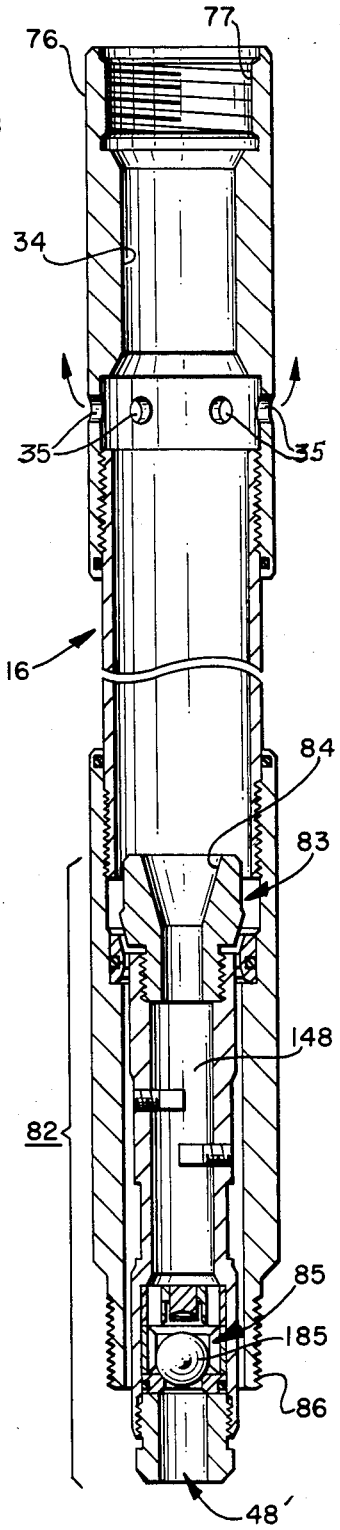
FIGS. 2 and 3 are enlarged, detailed, longitudinal, cross-sectional representations of part of the downhole jet pump of FIG. 1.

FIG. 2 is an enlarged detailed view which specifically sets forth one preferred embodiment of the pump cavity 16 of this invention, while FIG. 3 is a further enlarged detail which specifically sets forth one preferred embodiment of the pump 10 of this invention. The pump 10 of FIG. 3 is telescopingly received within the pump cavity 16 of FIG. 2, as diagrammatically indicated in FIG. 1.

Figure 4:
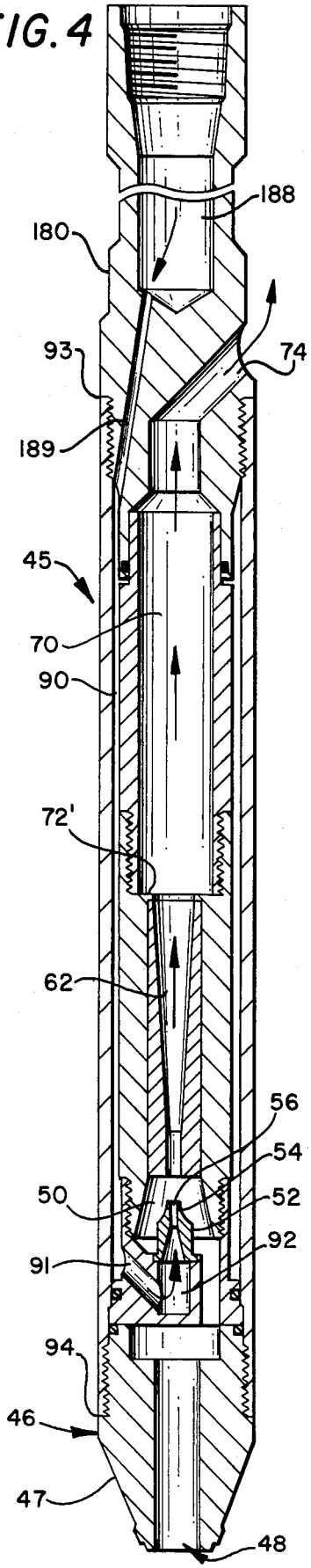
FIG. 4 is an enlarged, detailed, longitudinal, cross-sectional representation of a modification of the pump disclosed in FIG. 3.

As may be appreciated by those skilled in the art, and as illustrated in FIG. 4, the power fluid inlet 12 may be directly connected to the string of tubing for use with the present invention as a fixed type downhole pump; or, alternatively, the pump of this invention can be of the free type, such as disclosed in FIGS. 1 and 3.

In FIG. 3, an upper sub 44 forms part of the main pump body and is connected to a barrel 45, which in turn is connected to a formation inlet sub 46, so as to enable the various components of the pump to be easily serviced. The details of this construction are considered within the comprehension of those skilled in the art.

Inlet passageway 48' of the pump disclosed in FIGS. 1 and 3 of the drawings is connected to a suction chamber 50. As best seen in FIGS. 3–6, a nozzle 52 is affixed to the inlet sub 46 and is preferably provided with a very hard metal alloy jet formed at the free end 54 thereof. The outlet end 56 of the nozzle 52 freely extends into the suction chamber 50 and is spaced from venturi entrance 58 of the venturi assembly 60. Venturi throat 62 is concentrically arranged respective to the nozzle 52 and barrel 45, and extends axially away from the venturi entrance 58 in a downstream direction as the throat 62 diverges radially outwardly commencing at 58 and terminating at upper end 64.

Discharge chamber 66 has a frusto conical marginal length 68 and a constant diameter marginal length 70 concentrically arranged respective to one another and to the nozzle and venturi. The venturi throat 62 and discharge chamber entrance 68 therefore jointly cooperate together in the illustrated manner of FIGS. 3 and 4 to form the illustrated diverging passageway which assumes a constant diameter at interface 72.

The passageway 70, formed at the upper marginal end of the discharge chamber, is connected to mixed fluid outlet 15 or 74, which is the pump discharge. The pump discharge 15 or 74 exhausts into the annular chamber 36 which is connected to the before mentioned parts 35 of FIG. 1 to form a produced fluid flow path from the pump up to the wellhead 21.

As seen in FIGS. 3 and 4, the venturi has a throat which includes a circumferentially extending wall surface 62 in the form of a cone which is spaced from the end 56 of the nozzle 52. The conicity and mean diameter of wall surface 62 and the length thereof is selected to extract as much power as possible from the power fluid which exits nozzle 52.

The venturi entrance 58 is spaced from the nozzle outlet 56 so that formation fluid is sucked from the suction chamber 50 due to the velocity of the mass flow of the power fluid exiting the nozzle.

The power fluid and the entrance formation fluid flow into mixed fluid passageway 70 and exits the pump assembly at ports 15 or 74. Most all of the power has been extracted from the power fluid when the mixed fluids reach the mixed fluid passageway 70, except for the residual power required to lift the fluid to the surface.

FIG. 2 discloses the details of the pump cavity 16. The pump cavity 16 has an upper end 76 which is threaded at 77 and threadedly engages the lower end of the power oil string 18 of FIG. 1.

Seal 78 of FIG. 3 circumscribes boss 80 of the upper sub 44 and is sealingly received within the seal ring 34 of the pump cavity 16 of FIG. 2. A standing valve assembly 82 forms the lower marginal end of the pump cavity 16. The pump cavity is annular in cross-section and includes a pump seat 83 made complementary respective to the formation inlet sub 46, seen in FIGS. 3–5. The seat 83 is frusto conical as noted at 84 in FIG. 2. Attention is directed to my previous U.S. Pat. Nos. 3,957,400; 4,088,328; 3,703,926; and 3,517,741 for further details of various other standing valve assemblies and the operation thereof.

The standing valve 82 of FIG. 2 includes a valve assembly 85 which admits formation fluid through perforations 42 of FIG. 1, into inlet 48', across the ball valve element 185, through the inlet passageway 148, and into the pump inlet 48 of FIGS. 3 or 4.

The lower end of the pump cavity 16 is threaded at 86 for supportingly engaging a packer device 38, which can take on a number of different forms, and is known to those skilled in the art.

In FIG. 3, the upper inlet end 87 of the pump is attached to the packer nose assembly 30 seen in FIG. 1, and forms a passageway therein for the flow of the power oil to the power oil chamber 88. Radially spaced passageways 89 interconnect the oil chamber 88 with the power oil annulus 90. Inclined lateral port 91 interconnects the annulus 90 and the nozzle supply chamber 92 so that nozzle outlet 56 can be provided with a suitable power oil or power fluid supply.

Shoulder 93 is formed at the lower end of the sub 44 and receives the upper end of the pump barrel 45 in close tolerance relationship therewith.

Shoulder 94 is formed about the inlet sub 46 and receives the lower end of the pump barrel 45 in close tolerance relationship therewith.

Throughout the figures of the drawings, like or similar numerals, wherever logical to do so, refer to like or similar elements. In FIG. 4, power oil chamber 188 supplies oil to radial passageways 189, so that power fluid flows through annulus 90, through inclined ports 91, and into the nozzle supply chamber 92 where power fluid can be made available for the nozzle 52. The pump of FIG. 4 can be directly connected to a power oil string, or can be made of the free type, as may be desired.

Figure 5:
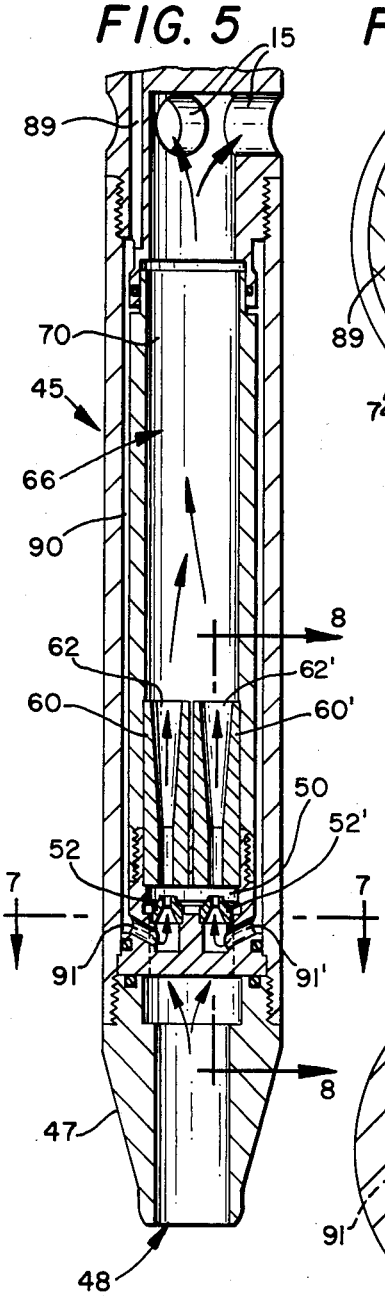
FIG. 5 is an enlarged, detailed, longitudinal, cross-sectional view of another embodiment of the invention.
Figure 6:
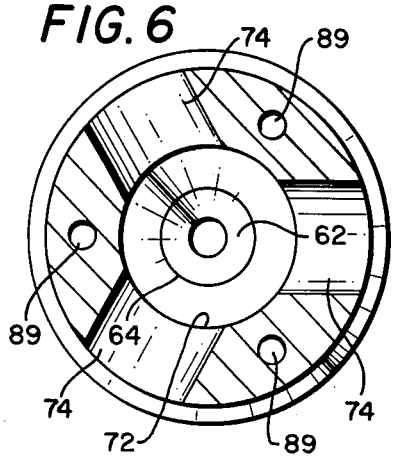
FIG. 6 is a cross-sectional view taken along line 6—6 of FIG. 3.
Figure 7:
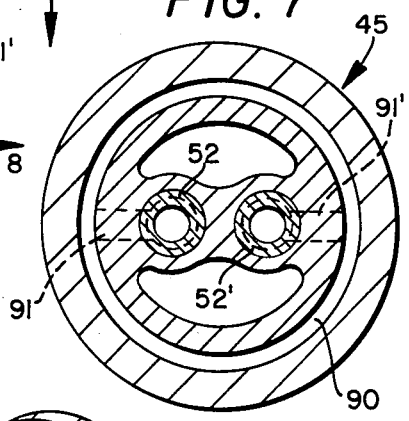
FIGS. 7 and 8 are cross-sectional views taken along lines 7—7 and 8—8 of FIG. 5.
Figure 8:
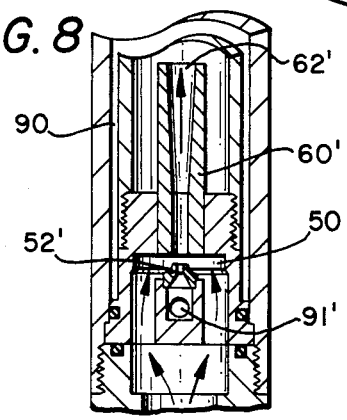

In FIG. 5, the pump has been provided with a plurality of nozzles 52, 52'; each of which are connected to the annulus 90 by means of individual inclined ports 91, 91'. Each nozzle 52, 52' is axially aligned and spaced longitudinally from a venturi 60, 60'. In FIG. 5, formation fluid flows from formation 43 (FIG. 1), into the standing valve assembly 82 (FIG. 2), into the pump inlet 48, and into the suction chamber 50.

The plurality of nozzles set forth in the embodiment of FIGS. 5–8 enable employment of the optimum size nozzle outlet and venturi combination which is considered consistent with the volumetric flow and pressure of the power fluid and formation fluid. One, two, or three nozzle and venturi assemblies can be used in the suggested manner of FIGS. 5, 7, and 8.

The spacing between the nozzle outlet 56 and venturi inlet 58, along with the length and diameter of the discharge chamber 66 is ascertained by means of prior art expedients.

In the embodiment of the invention disclosed in FIG. 9, the free type pump 110 has a packer nose assembly 30 located below the uppermost end 12 thereof, which is illustrated in the form of a fishing neck, with there being power fluid inlets or ports 192 formed between the fishing neck 12 and the packer 30 to thereby provide a source of power fluid for the interior 92 of tubing 87. The packer 30 is slidably received in sealed relationship against the interior surface of the tubing 18, which serves as the power oil string.

The downhole jet pump assembly 110 is pumped downhole until the nose 47 thereof sealingly engages the illustrated standing valve assembly 48'. Examples of a standing valve assembly 48' is seen in my previous U.S. Pat. Nos. 3,517,741 and 3,915,595. Exhaust ports 174 of the downhole pump 110 are aligned with the annular area formed between the spaced seal members 78 and 78'.

Multiple stage jet assembly 152 comprises a plurality of circumferentially spaced jet nozzles 154, each having an outlet end 156. The jet assembly 152 is axially aligned respective to a venturi assembly 160. Accordingly, the venturi assembly and the jet nozzle assembly each lie along the longitudinal axial centerline of the tubing 18. One of each of the nozzles 154 of the nozzle assembly is axially aligned respective to one of each of the venturi 160' of the venturi assembly 160.

An unexpected advantage of the embodiment of this invention 110 is the unrestricted access that the illustrated configuration provides to the nozzle assembly 152 and to the venturi assembly 160 respective to the inlet chamber 150.

In operation, the pump assembly 110 is circulated downhole until the lowermost end of 47 thereof abuttingly engages and opens the standing valve assembly 48'. This makes formation fluid at 40 available through valve means 185 and at the intake 48 of the pump 110.

Power fluid flowing from the surface, and down power oil string 18 enters the packer nose assembly at ports 192 and flows into the passageway 92, where the power fluid is available at ports 91' for each of the nozzles 154 of the nozzle assembly 152.

Flow of power fluid through each of the nozzle outlets 156 is directed along the axial centerline of the aligned nozzles 152 and thereby forces formation fluid at 150 to flow into the venturi section 160', into the chamber formed between the seal members 78, 78', through the exhaust ports 174, and up the annulus 20 formed between the power oil string 18 and the casing 24.

Figure 9:
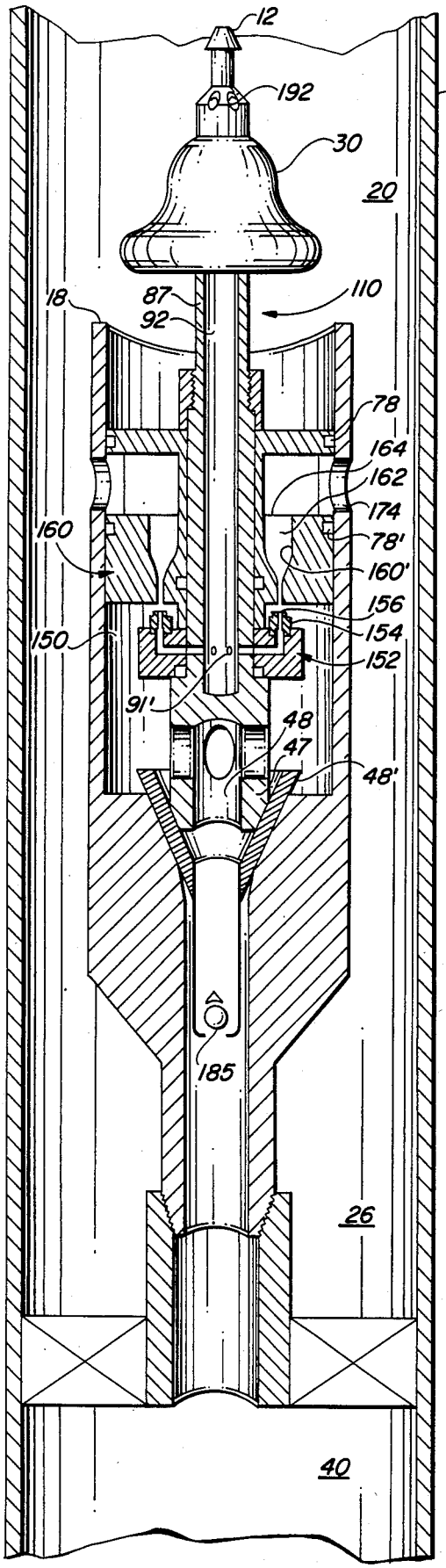
FIG. 9 is a fragmentary, longitudinal, part cross-sectional view of part of a borehole having a downhole pump assembly made in accordance with another embodiment of the invention.
Figure 12:
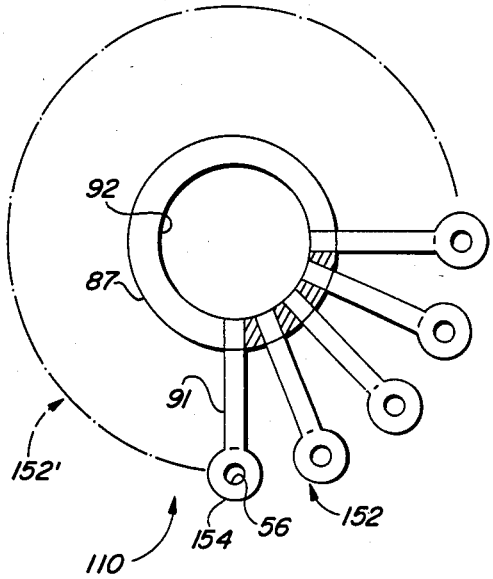

The nozzle assembly 152 of FIG. 9 can be made as illustrated, or alternatively can be made in the manner of FIG. 12. Those skilled in the art, having completely digested the teachings of FIG. 9, will comprehend several different manners by which the downhole pump 110 can be made into the fixed type of FIG. 11 rather than the illustrated free type of FIG. 9.

Figure 10:
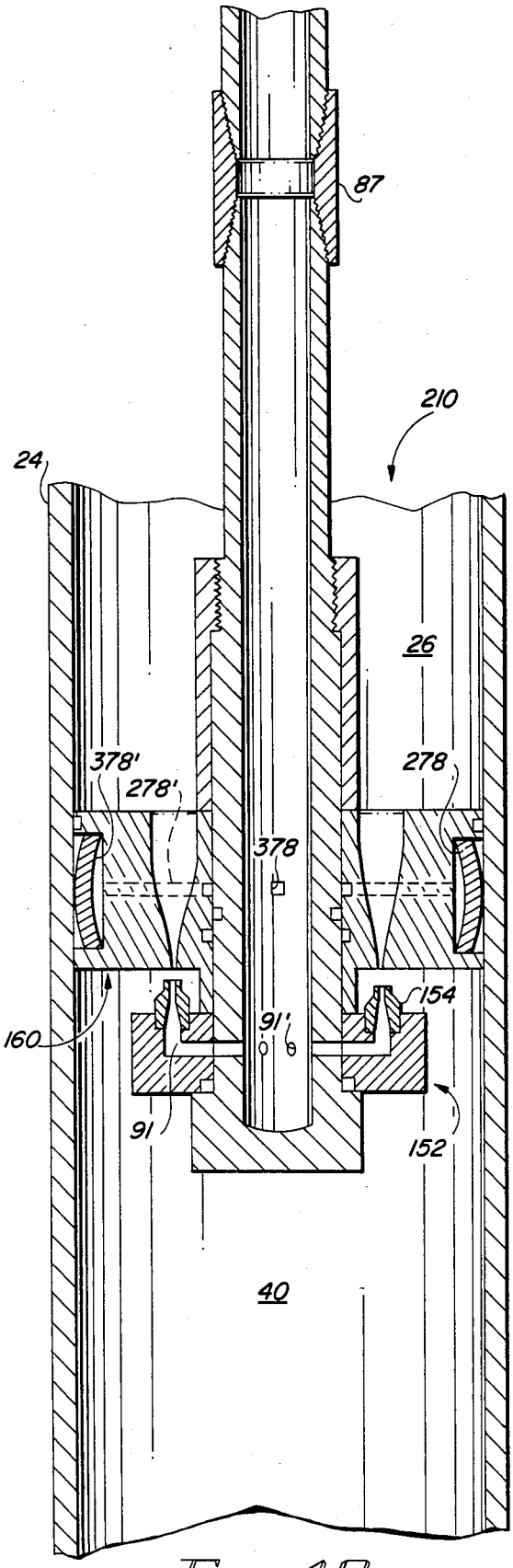
FIG. 10 is a fragmentary, longitudinal, part cross-sectional view of still another embodiment of the present invention.

In FIG. 10, there is disclosed still another embodiment 210 of the present invention, wherein there is provided a packer apparatus 278 that forms a seal against the peripheral wall of pipe 24 and thereby divides the lower part 40 of the cased borehole from the upper part 26 thereof. Fluid flowing through power fluid string 87 is available at radial ports 378 which are connected at 278' to the annular chamber 378' so that a pressure differential across packer device 278 seals tightly against the interior of the casing 24. At the same time, power fluid continues to ports 91' where the individual jets 154 of the jet assembly 152 each cooperate with their respective aligned venturi of the venturi assembly 160 and thereby causes formation fluid at 40 to flow uphole at 26.

Figure 11:
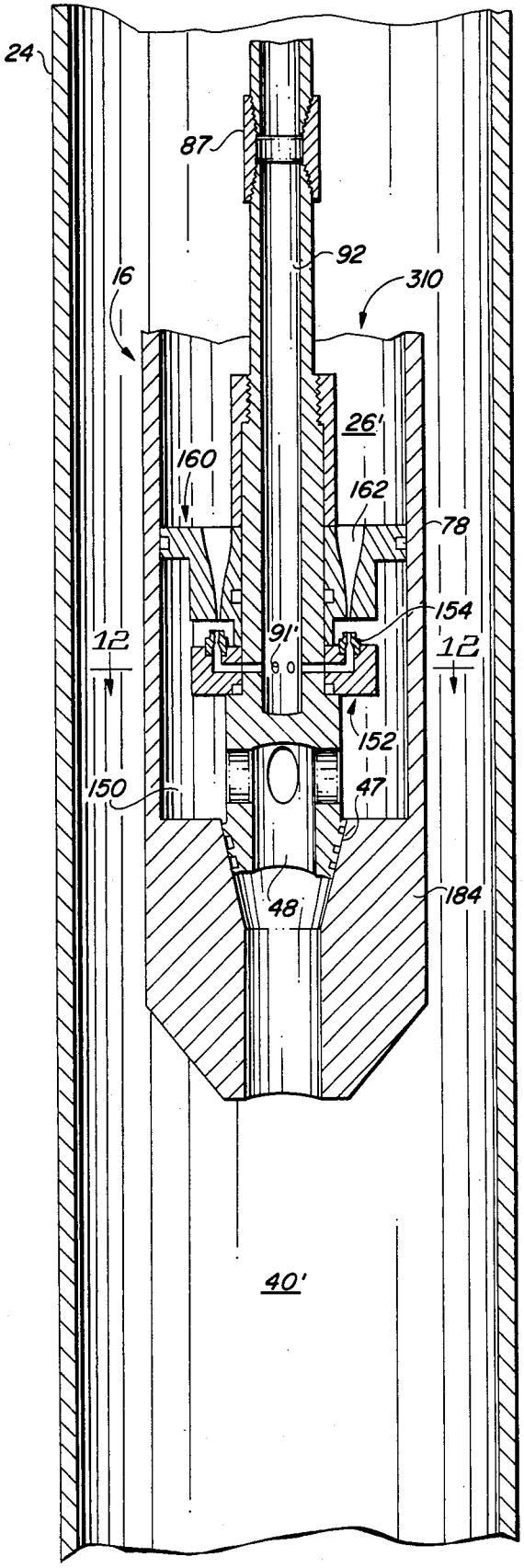
FIG. 11 is a broken, longitudinal, cross-sectional view of a wellbore having still another embodiment of the present invention located therewithin; and, FIG. 12 is a cross-sectional view taken along line 12—12 of FIG. 11, for example.

In the embodiment 310 of the invention set forth in FIG. 11, there is a single seal member 78 suitably affixed to the pump housing. The oil string 87 is used to run the pump into and out of the borehole. The lower end 47 of the pump assembly sealingly engages the apparatus 184 and thereby provides an inlet.

In operation of the embodiment seen at 310, power oil flows at 87, through ports 91', through passageway 91 of the jet assembly and to the multiplicity of circumferentially extending nozzles 154. One of each of the nozzles 154 is axially aligned with one of the venturi 162 of a venturi assembly 160 as in the before described manner.

Accordingly, formation fluid at 40' enters the pump suction 48 and flows into chamber 150 where the jet action from nozzles 154 force the formation fluid into the venturi assembly and up through the interior of the tubing 16 and to the surface of the ground. Applicant has found that a plurality of small jet and venturi assemblies are superior to one large jet and venturi assembly, and accordingly, the present invention provides increased efficiency of operation, low maintenance, and reduced cost of manufacture.

I claim:

1. A downhole jet pump for producing fluid from a wellbore; said pump has a pump body, an upper and lower end, and a longitudinal axis; said pump body includes means forming a packer nose assembly at the upper end thereof by which said pump can be circulated into and out of the wellbore; a longitudinally extending axial bore formed within said main body, said axial bore is separated into an upper power fluid passageway and a lower formation fluid passageway to receive power fluid from a source located above the surface of the ground and to receive formation fluid from the lower end of the borehole;

means mounting a nozzle assembly at the lower end of said pump body, said nozzle assembly includes a plurality of radially spaced nozzles which are circumferentially arranged about the longitudinal axis of said pump body; said nozzles each have a jet end spaced from an inlet end, passage means connecting each nozzle to the upper power fluid passageway of the axial bore; a venturi assembly axially aligned respective to said nozzle assembly, said venturi assembly includes a plurality of venturi each having an inlet and outlet;

a tubing string extending into the wellbore into communication with a production zone, means forming a pump cavity located downhole in the borehole at the end of the tubing string for removably receiving said pump in sealed relationship therewithin; an annulus is formed between said tubing string and the borehole through which produced fluid admixed with spent power fluid is conducted uphole to the surface of the ground;

seal means positioned about said pump body by which said pump body and said cavity jointly form a suction annulus and a produced fluid annulus spaced from one another by said venturi assembly, said suction annulus is concentrically arranged about the jet end of said nozzle assembly and the inlet end of the venturi assembly, and thereby provides formation fluid flow into the inlet end of the venturi assembly whereupon the formation fluid is forced to flow through the venturi assembly and into said produced fluid annulus located within said pump cavity; means by which said inlet end of each said nozzles of the assembly is directly connected to said power fluid in the axial passageway such that power fluid can flow into said inlet end, through the interior of said nozzle assembly, and out of said jet end thereof;

a formation fluid inlet means connected at the lower end of said axial bore, means forming a flow passageway extending from said formation fluid inlet means, through said lower formation fluid passageway of said axial bore, and into said suction annulus;

said venturi assembly is of annular construction and sealingly engages the interior of the cavity wall and is spaced from said nozzle assembly; said inlet end of each said venturi is placed adjacent to said jet end of each said nozzle; said suction annulus is separated from the produced fluid annulus by said venturi assembly; an annuluar member spaced above said venturi asembly; said produced fluid annulus commences in proximity of the venturi outlet and extends to said annular member; and an outlet port formed in said cavity and connected to said produced fluid annulus for conducting mixed fluid flow away from the jet pump, into the annulus between the tubing and the wellbore, and towards the surface of the ground.

2. A jet pump for producing fluid from a wellbore having formation fluid located in the bottom thereof; said pump comprising a pump body having an upper end opposed to a lower end, and a longitudinal extending axial bore formed therein having an upper marginal end to receive power fluid from a source located above the surface of the ground and a lower marginal end to receive formation fluid from the bottom of the borehole; a nozzle assembly mounted at the lower end of said pump body, said nozzle assembly includes a plurality of individual radially spaced nozzles which are circumferentially arranged about the longitudinal axis of said pump body; said nozzles each have a jet end spaced from an inlet end, passage means connecting said inlet end of each said nozzle to the upper marginal end of said axial bore to provide each nozzle with a source of power fluid;

a tubing string forms an upper borehole annulus which is separated from the lower borehole by a packer means so that produced fluid from the pump can be exhausted into and flow up the borehole annulus; means forming a pump cavity located dowhole in the tubing string for removably receiving said pump in sealed relationship therein;

a venturi assembly mounted to said main body; said venturi assembly is axially aligned with respect to said nozzle assembly and has a plurality of venturi, each having an inlet end and an outlet end; said inlet end of each said venturi is placed adjacent to said jet end of said nozzle assembly; said venturi assembly has a large outside diameter greater than the outside diameter of the nozzle assembly; an annular member spaced from said venturi assembly and forming an annular produced fluid chamber therebetween; seal means on the exterior of said venturi assembly by which said pump body and cavity form a suction annulus and said annular produced fluid chamber by which formation fluid is placed around the nozzle outlets and venturi inlets, and which separate the formation fluid, power fluid, and produced fluid;

said seal means, pump body, and cavity form said suction annulus concentrically about the jet end of said nozzle assembly and within said pump cavity at a location near the lower end of said pump body; whereby, power fluid flows into said axial bore by way of a power fluid inlet means, through the nozzle assembly, out of said jet end thereof, into the entrance of said venturi assembly thereby forcing power fluid admixed with production fluid into the annular produced fluid chamber;

the upper marginal end of said axial bore is separate from the lower marginal end thereof, a formation fluid inlet means connected to said axial bore at the lower end of said pump body, and separated from said power fluid inlet means; means forming a flow passageway extending from said formation fluid inlet means into said suction annulus;

said seal means includes a seal located on said venturi assembly by which the formation fluid flow path about the venturi inlets is spaced from the produced fluid flow path about the venturi outlets, said produced fluid flow path commences in proximity of the venturi outlet end and extends to a location adjacent to said annular member; an outlet port formed in said cavity connected to said annular produced fluid chamber for conducting mixed fluid flow away from the jet pump, through said tubing string, up the borehole annulus and towards the surface of the ground.

3. The jet pump of claim 2 wherein said pump body terminates in an upper sub, a packer nose assembly connected to said upper sub;

said power fluid inlet means extends through said packer nose assembly, through said upper sub, and into communication with the inlet end of said nozzle assembly;

an inlet sub at the lower end of said pump body, said suction annulus being formed above said inlet sub; said outlet port being formed through said cavity wall and being directly connected to said annular produced fluid chamber so that fluid flows from said nozzle assembly, through said venturi assembly, into said annular produced fluid chamber, and then through said outlet port into the annulus between the tubing and borehole wall and uphole to the surface of the ground.

* * * * *